US009714742B1

(12) United States Patent
Jackson

(10) Patent No.: US 9,714,742 B1
(45) Date of Patent: Jul. 25, 2017

(54) LIGHT SOURCE CARRIER

(71) Applicant: Peacock Myers, P.C., Albuquerque, NM (US)

(72) Inventor: Kevin R. Jackson, Albuquerque, NM (US)

(73) Assignee: Peacock Myers, P.C., Albuquerque, NM (US)

( * ) Notice: Subject to any disclaimer, the term of this patent is extended or adjusted under 35 U.S.C. 154(b) by 209 days.

(21) Appl. No.: 13/958,402

(22) Filed: Aug. 2, 2013

Related U.S. Application Data

(60) Provisional application No. 61/679,575, filed on Aug. 3, 2012, provisional application No. 61/778,316, filed on Mar. 12, 2013, provisional application No. 61/807,625, filed on Apr. 2, 2013.

(51) Int. Cl.
*F21K 2/06* (2006.01)

(52) U.S. Cl.
CPC ..... *F21K 2/06* (2013.01)

(58) Field of Classification Search
CPC ..... F21K 2/06; B65D 85/14
USPC ..... 362/34
See application file for complete search history.

(56) References Cited

U.S. PATENT DOCUMENTS

| | | | | |
|---|---|---|---|---|
| 3,813,534 | A | 5/1974 | Gilliam | |
| 5,029,049 | A | 7/1991 | Ladyjensky | |
| 5,067,051 | A | 11/1991 | Ladyjensky | |
| 5,190,366 | A * | 3/1993 | World | F21K 2/00 362/234 |
| 5,344,670 | A | 9/1994 | Palmer | |
| 5,430,622 | A | 7/1995 | Kuo et al. | |
| 5,508,893 | A | 4/1996 | Nowak et al. | |
| 5,599,551 | A | 2/1997 | Kelly | |
| 5,671,998 | A | 9/1997 | Collet | |
| 5,705,103 | A | 1/1998 | Chopdekar et al. | |
| 5,938,313 | A * | 8/1999 | Fujita | F21K 2/06 362/34 |
| 6,012,820 | A | 1/2000 | Weber et al. | |
| 6,062,380 | A | 5/2000 | Dorney | |
| 6,471,364 | B1 | 10/2002 | Plante | |
| 6,572,244 | B1 * | 6/2003 | Clark | A23G 3/50 362/109 |
| 6,685,331 | B1 | 2/2004 | Rockwell | |
| 7,083,294 | B2 | 8/2006 | Steinberg | |
| 7,216,998 | B2 | 5/2007 | Fujita | |
| 7,234,827 | B2 | 6/2007 | Fujita | |

(Continued)

FOREIGN PATENT DOCUMENTS

| | | |
|---|---|---|
| CN | 202140799 | 2/2012 |
| JP | 2173180 | 7/1990 |

(Continued)

OTHER PUBLICATIONS

Chapa, "Recycled tube light by Castor Canadensis", Sep. 26, 2007, http://inhabitat.com/recycled-tube-light-by-castor-canadensis/.

(Continued)

*Primary Examiner* — Karabi Guharay
(74) *Attorney, Agent, or Firm* — Isaac Estrada; Justin R. Jackson; Peacock Myers, P.C.

(57) ABSTRACT

A glow stick carrier comprising one or more openable containers for carrying at least one substance, and one or more attachments of the container to a glow stick.

47 Claims, 7 Drawing Sheets

(56) References Cited

U.S. PATENT DOCUMENTS

| | | | | |
|---|---|---|---|---|
| 7,416,689 | B2 | 8/2008 | Yamate | |
| 7,438,428 | B2 | 10/2008 | Schrimmer et al. | |
| 7,614,512 | B2 | 11/2009 | Nader | |
| 7,682,033 | B2 | 3/2010 | Cranor | |
| 8,348,465 | B2 | 1/2013 | Schrimmer et al. | |
| 2003/0137827 | A1 | 7/2003 | Bouton et al. | |
| 2005/0007760 | A1 | 1/2005 | Wu | |
| 2006/0098420 | A1* | 5/2006 | Kaplan et al. | 362/34 |
| 2007/0047216 | A1* | 3/2007 | Piazzolla | 362/34 |
| 2007/0090010 | A1 | 4/2007 | Crabtree et al. | |
| 2008/0057089 | A1 | 3/2008 | Molina | |
| 2008/0230504 | A1 | 9/2008 | Nowzari | |
| 2008/0246009 | A1 | 10/2008 | Fujita et al. | |
| 2009/0185995 | A1 | 7/2009 | Vochecowicz et al. | |
| 2009/0207582 | A1 | 8/2009 | Dorsey et al. | |
| 2010/0014275 | A1 | 1/2010 | Cranor | |
| 2010/0020529 | A1* | 1/2010 | Brooks et al. | 362/34 |
| 2011/0114802 | A1* | 5/2011 | Hjerpe | F16L 3/222 248/68.1 |
| 2011/0284583 | A1 | 11/2011 | Fazzolari | |
| 2012/0056131 | A1 | 3/2012 | Nagel | |
| 2012/0097063 | A1 | 4/2012 | Cranor et al. | |
| 2012/0230009 | A1 | 9/2012 | Friedson | |
| 2012/0275142 | A1* | 11/2012 | Lundy | F21L 4/027 362/184 |
| 2013/0001485 | A1 | 1/2013 | Li et al. | |

FOREIGN PATENT DOCUMENTS

| | | |
|---|---|---|
| JP | 2011137134 | 7/2011 |
| WO | 2007052092 | 5/2007 |
| WO | 2008007381 | 1/2008 |

OTHER PUBLICATIONS

Cosmic Bear Glow in the Dark Lubricant, http://naturelabsbrands.com/personal-lubricant/nature-lovin/cosmic-bear, Apr. 29, 2013.

* cited by examiner

LIGHT SOURCE CARRIER

CROSS-REFERENCE TO RELATED APPLICATIONS

This application claims priority to and the benefit of the filings of U.S. Provisional Patent Application Ser. No. 61/679,575, entitled "GLOW STICK", filed on Aug. 3, 2012; U.S. Provisional Patent Application Ser. No. 61/778,316, entitled "GLOW STICK", filed on Mar. 12, 2013; and U.S. Provisional Patent Application Ser. No. 61/807,625, entitled "GLOW STICK CARRIER", filed on Apr. 2, 2013; and the specifications and claims thereof are incorporated herein by reference.

BACKGROUND OF THE INVENTION

Field of the Invention (Technical Field)

The present invention relates to carriers, and more particularly to carriers/containers for products such as, but not limited to, liquor, paint, candy (hard, liquid, powder), antibiotics, hand sanitizer, intimate lubricant ("lube"), cigarettes, cosmetics, other objects, etc., that are attachable to a glow stick. Embodiments of the present invention also relate to a solution comprising a phosphor of a different wavelength to create different fluorescent colors around or inside a glow stick.

Description of Related Art

Glow sticks are plastic cylinders that contain two liquids that temporarily create light when they are mixed together. The cylinders typically are about 4 to 5 inches long and less than 1 inch in diameter. Glow sticks are available in many colors and are often used for decoration or entertainment, such as at parties, concerts and other nighttime events. They also have some practical uses for camping, military or police operations, underwater activities, or certain emergency situations. Thin, long glow sticks that are made of a more flexible plastic can take the form of necklaces, bracelets or other shapes. No matter what form they take, glow sticks depend on a chemical process known as chemiluminescence to produce their light. In chemiluminescence, a chemical reaction causes a release of energy. Electrons in the chemicals become excited and rise to a higher energy level. When the electrons drop back to their normal levels, they produce energy in the form of light. The chemicals used to create this reaction in glow sticks are usually hydrogen peroxide and a mixture of phenyl oxalate ester and the fluorescent dye. A different way to create a glow stick can be the integration of a light-emitting diode ("LED") with a container for a solid, liquid, gas, or combinations thereof.

Embodiments of the present invention improve the marketability of commercially-available glow sticks by combining or integrating them with containers for other products that, depending on the occasion and use for the glow stick, can promote a substance.

BRIEF SUMMARY OF THE INVENTION

Embodiments of the present invention comprise a glow stick carrier apparatus comprising an openable container for carrying at least one substance, and an attachment of the container to a glow stick. In one embodiment, the openable container is flexible and elongated and the attachment comprises wrapping the container around the glow stick. In one embodiment, the openable container comprises a spiraling shape. In one embodiment, the openable container comprises at least one closed end to insert at least one substance and contain it therein. In another embodiment, the attachment comprises a snapping projection for receiving the container. In one embodiment, the openable container is transparent.

Embodiments of the present invention comprise multiple containers that are disposed around the glow stick. In one embodiment, the multiple containers comprise tubes, and tube caps. In one embodiment, the attachment comprises snapping projections for receiving the containers, or a rubber band. In one embodiment, the openable containers are transparent.

In a different embodiment, the attachment is a cavity shaped to accommodate the openable container for carrying at least one substance. Optionally, the cavity and the openable container are cylindrical in shape. In one embodiment, the cavity and the openable container comprise threading so that the openable container remains attached to the cavity. In one embodiment, the openable container further comprises a dispensing mechanism for the at least one substance contained within the openable container. Preferably, the openable container protrudes from the cavity.

In a different embodiment, the openable container comprises a chemiluminescent mechanism comprising a phosphor of a different wavelength than a wavelength in the glow stick to create a different fluorescent color combination.

A different embodiment comprises multiple containers and multiple cavities, or multiple glow sticks.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

As used throughout this application, the term "phosphors" means substances that radiate visible light when they are energized, for example, calcium sulfide with strontium sulfide with bismuth as an activator to yield blue light or strontium sulfide to obtain red light.

As used throughout this application, the term "substance" can include any solid, liquid, gas, or combination thereof. In one embodiment, the term substance can optionally include but is not limited to a substance which can be for an opportune use—for example, candy for a child's party, or liquor or lube for adults at a night club.

As used throughout this application, the term carrier means one or more containers for carrying any substance or object, whether solid, liquid, gaseous, combinations thereof, and the like.

As used throughout this application, the term "finishes" refers to the outer or inner surface texture or appearance produced by a treatment, coating, or color printing.

As used throughout this application, the term "glow stick" refers to a self-contained, short-term light-source, preferably made from a translucent plastic tube comprising isolated substances that, when combined, make light through chemiluminescence, or light sources that can substitute these sources, e.g., a light-emitting diode ("LED") integrated with a container for a solid, liquid, gas, or combinations thereof.

As used throughout this application, the term "attachment" means any means of attaching, disposing, coupling, or affixing a container to a glow stick, including but not limited to, gluing, snapping, hanging, taping, stapling, tying, etc.

Figure 1:
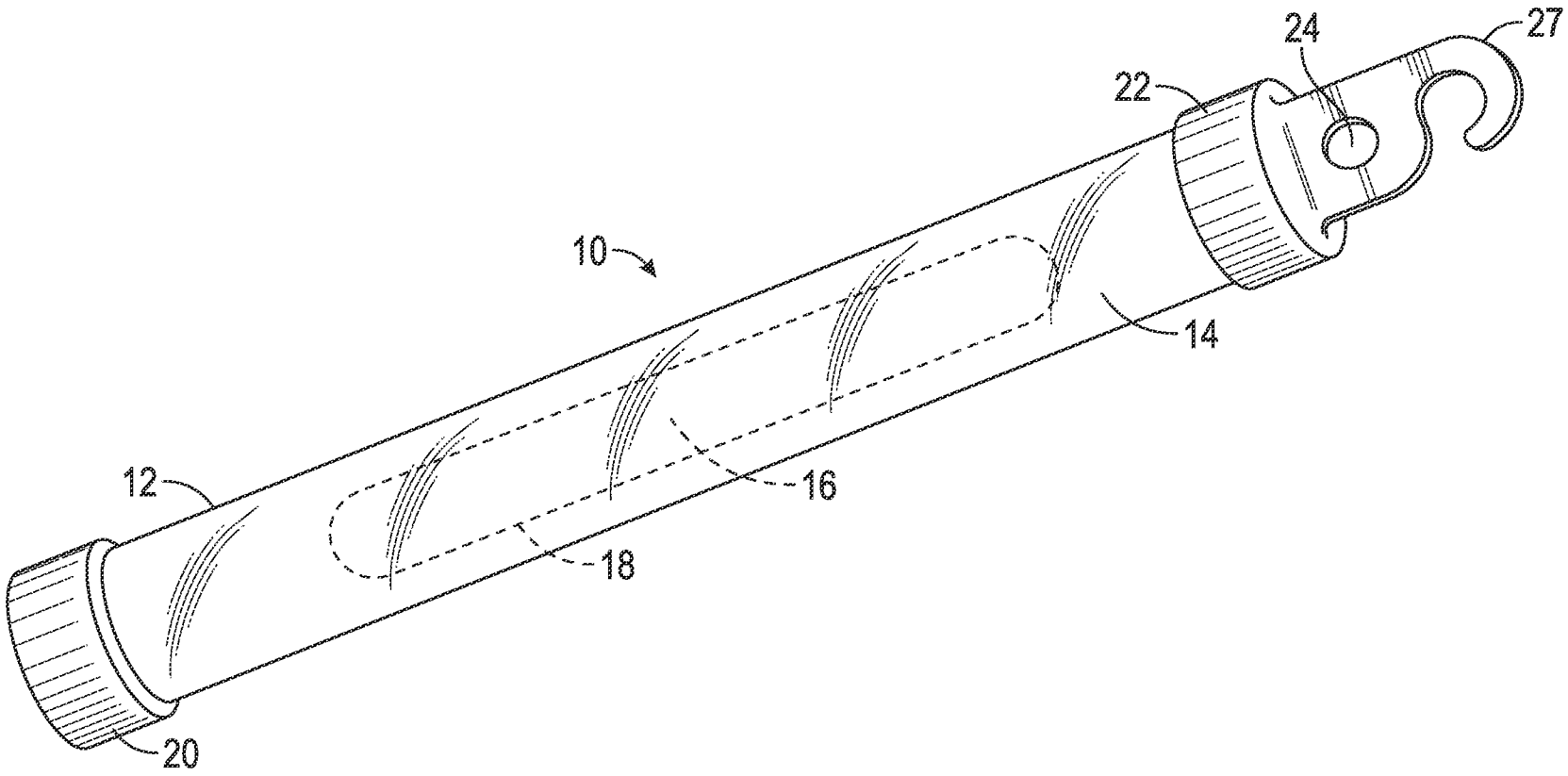
FIG. 1 is a perspective view schematic of an off-the-shelf glow stick.

Referring to FIG. 1, a common glow stick is shown generally comprising cylindrical housing 10, comprising chemo-luminescent reagent holding area 12, which is filled with first reagent 14. Second reagent 16 is contained in fragile ampoule 18, which resides also in chemo luminescent reagent holding area 12. Rupture of fragile ampoule 18 through some sort of manipulation, e.g., bending cylindrical housing 10, causes the two reagents to mix and produce chemiluminescence. Some commercially available glow sticks are manufactured as a single piece injection-molded-body that comprises a projection at one end providing coupling means, e.g., a hook, to hang the glow stick from a lanyard or the like. However, many glow sticks comprise caps 20 and 22 at their ends, wherein cap 22 comprises said projections. In FIG. 1, cap 22 comprises a projection defining eye 24, and hook 27 for hanging.

Figure 2:
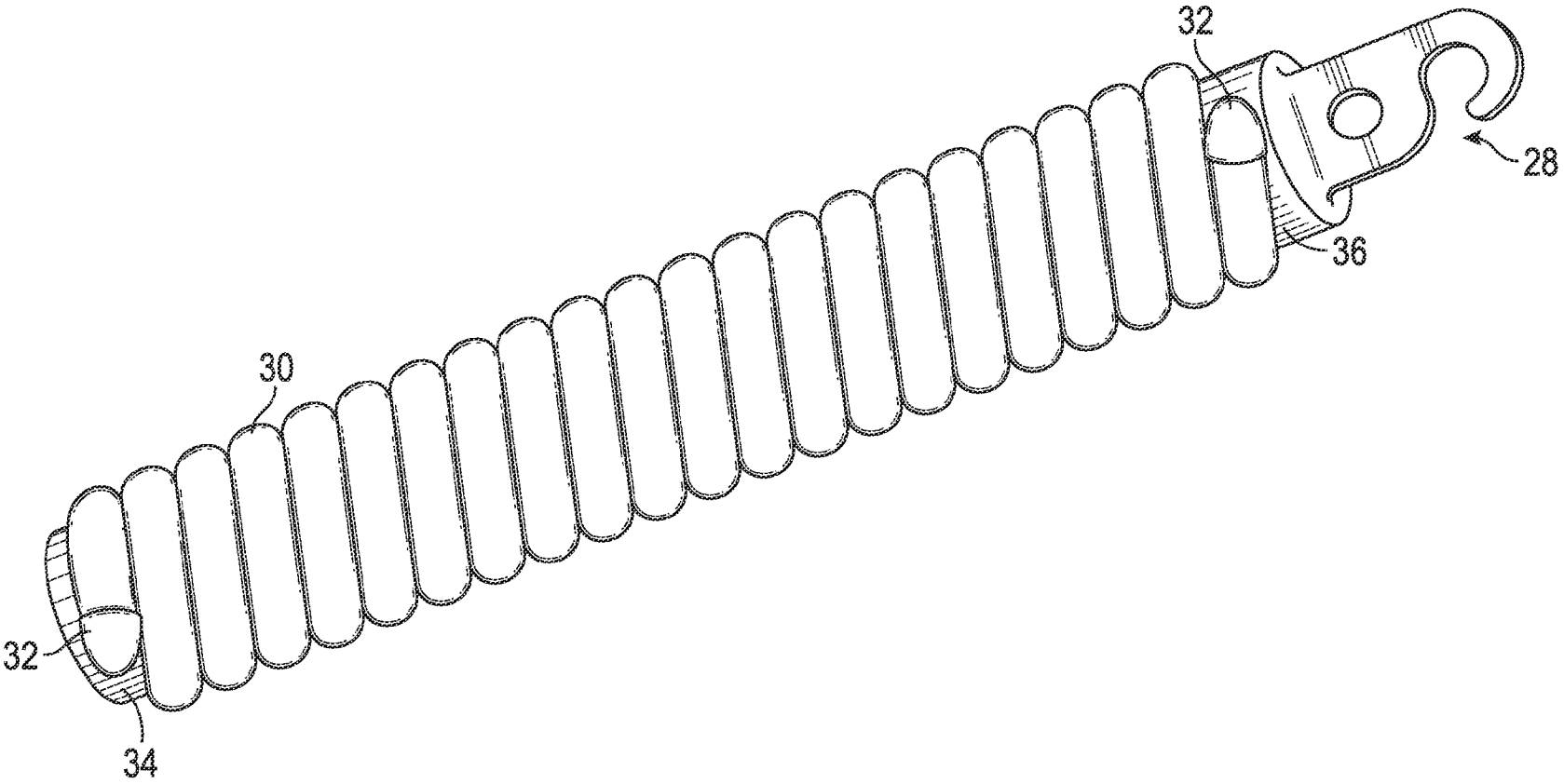
FIG. 2 is a perspective view of one embodiment of the present invention comprising a flexible, hose-like container wrapped around a glow stick.

Referring to FIG. 2, in one embodiment of the present invention, glow stick 28 has disposed around it flexible hose-like container 30. Container 30 can, in some embodiments, comprise one or more caps 32. Container 30 can be manufactured of flexible materials such as, but not limited, to plastic and in diverse colors. In a preferred embodiment, container 30 is translucent and/or transparent. In a different embodiment, container 30 is made from a combination of different materials in diverse patterns. Some of these materials can diffract or conduct light, like optic fiber, to create visual effects as the light emitted from glow stick 28 passes through container 30. In one embodiment of the present invention, flexible container 30 wraps around glow stick 28. Container 30 is secured to glow stick 28 in any manner, including via entrapment of ends of flexible container 30 at or near the bottom and top ends of glow stick 28, for example, with a modification on caps 34 and 36 to allow the ends of container 30 to, for example, snap on, or be tucked under caps 34 and 36. Other means to secure the ends of container 30 to the ends of glow stick 28, include but are not limited to, snapping mechanisms, glue, rubber bands, etc.

Figure 3:
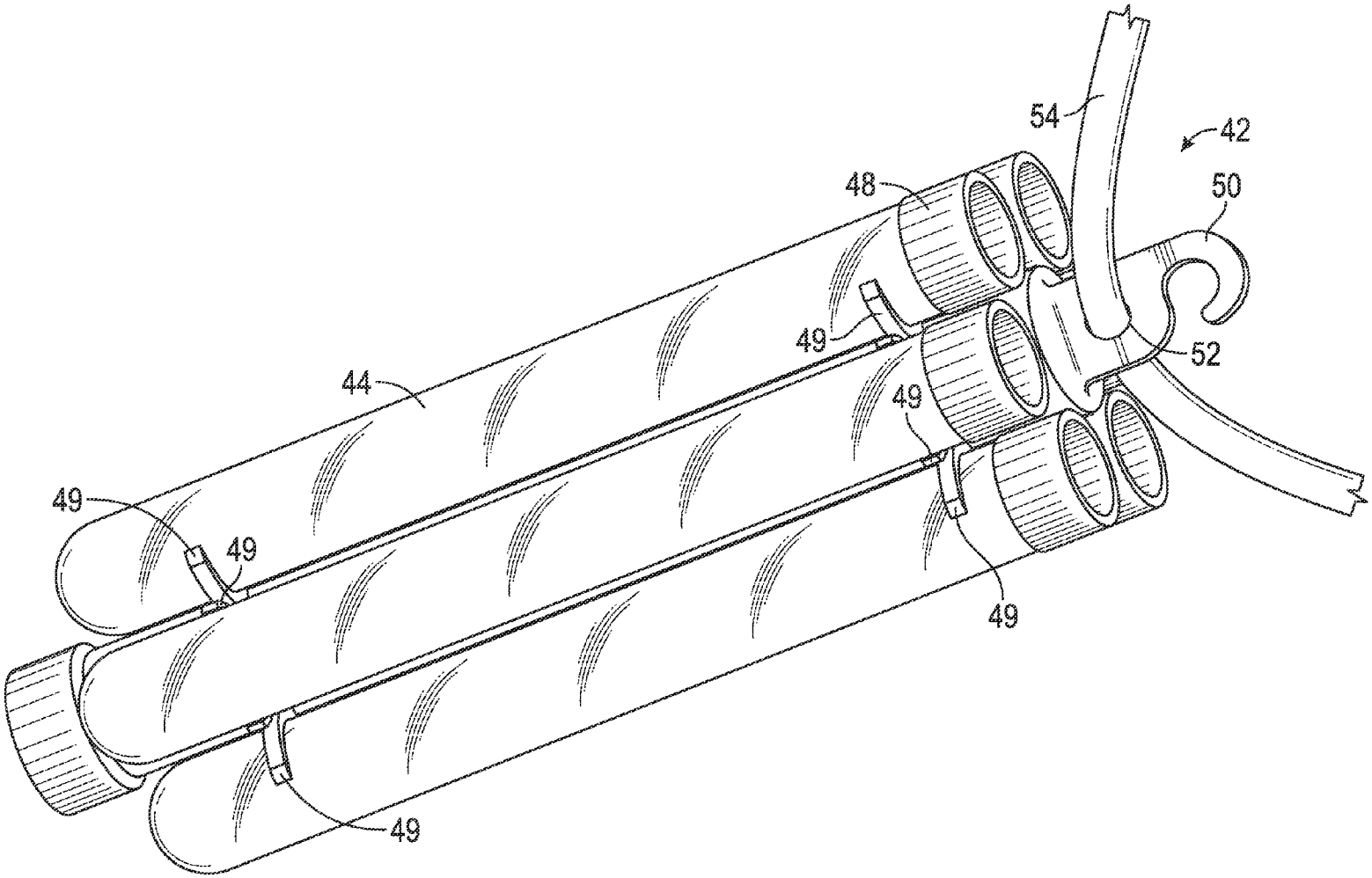
FIG. 3 is a perspective view of a different embodiment of the present invention.
Figure 4:
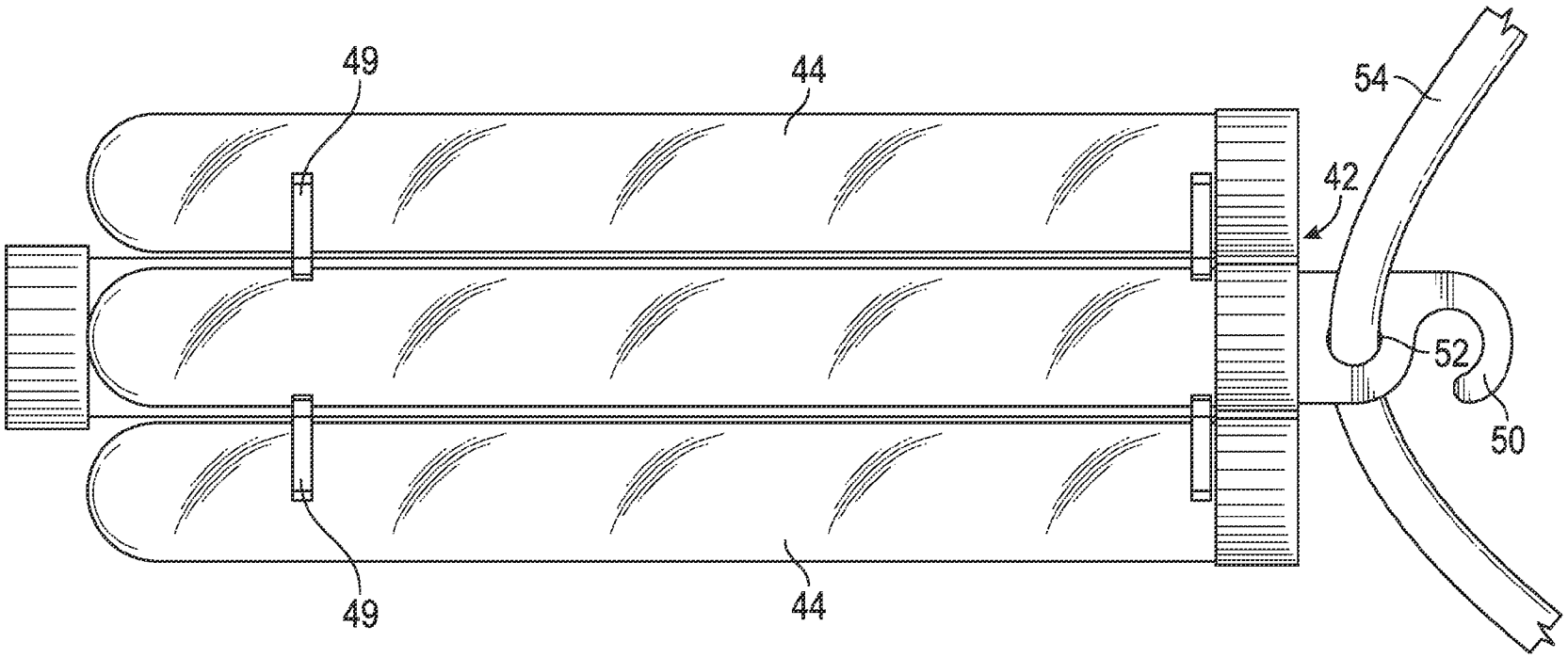
FIG. 4 is a side view of the embodiment of FIG. 3.
Figure 5:
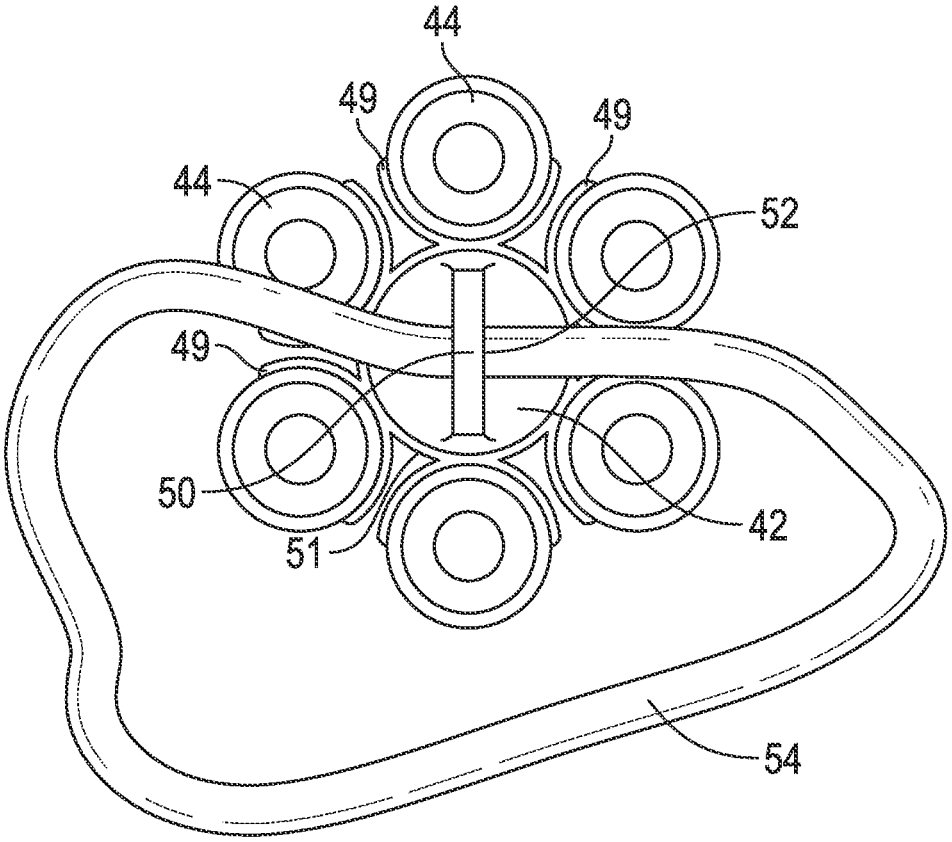
FIG. 5 is a top view of the embodiment of FIG. 3.

Referring now to FIGS. 3-5, in a different embodiment of the invention, glowing stick 42 is surrounded by one or more carrier tubes 44. Carrier tubes 44 may be molded into one piece or can be attached to one another by conventional means such as glue, tape, etc., or be held in place, for example, with one or more tube holders 51 (see FIG. 5), which preferably comprise a plurality of snapping projections 49, preferably adapted to hold each carrier tube 44 and allow them to be snapped on and off. Preferably, glow stick 42 is slipped into and out of a group of carrier tubes 44. Optionally, each one of carriers 44 is taken apart from the group one at a time as desired. In one embodiment of the invention, tube holders 51 are molded on the glow stick caps. Other means of holding carrier tubes 44 together and dispose them on glow stick 42 include but are not limited to glue, rubber bands, etc. In one embodiment, a group of one or more carrier tubes 44 are attachable to glow stick 42 itself. In one embodiment, a group of one or more carrier tubes 44 spins around glow stick 42 with, for example, bearings.

Carrier tubes 44 are preferably sized and optimized to carry diverse items, for example, cigarettes and/or other tobacco products. Preferably, the shape, size, and properties of carrier tubes 44, and their arrangement around glow stick 42 depend on context and the use for the apparatus. For instance, glow sticks for an emergency kit may have a carrier associated with them comprising first aid supplies. In a different embodiment, a glow stick to be used at a children's birthday party may have candy, party favors such as small toys, and/or a soapy solution to make bubbles with a carrier tube cap adapted with a bubble blower, etc. Carrier tubes that hold liquids or gases are adapted for such purposes with, for example, gaskets, appropriate thickness, etc. Carrier tubes 44 can be adapted to carry many different things, e.g., but not limited to, drugs and pharmaceuticals where the local laws permit them, tools, flowers, jewelry, survival supplies, food, cosmetics, bullets, drinks, espionage equipment, electronics, seeds, money, other carriers, etc.

Preferably, carrier tubes 44 comprise one or more caps 48 or other means to make them openable/closable. Alternatively, carrier tubes 44 are one-time use, disposable containers. Preferably, one cap of glow stick 42 comprises projection 50, defining eye 52 to preferably accommodate lanyard 54 so that users can hang the apparatus around their necks. In a preferred embodiment, carrier tubes 44 are at least partially transparent. In a different embodiment, a light element, for example an LED light source, replaces glow stick 42.

Figure 6:
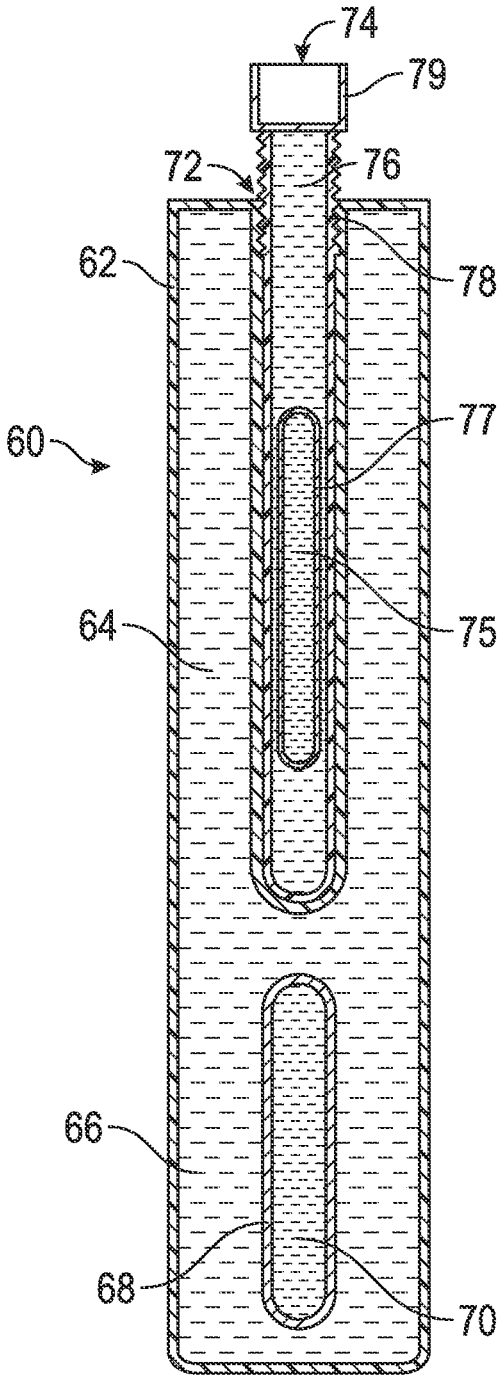
FIG. 6 is a cross-sectional view of a different embodiment of the present invention.
Figure 7:
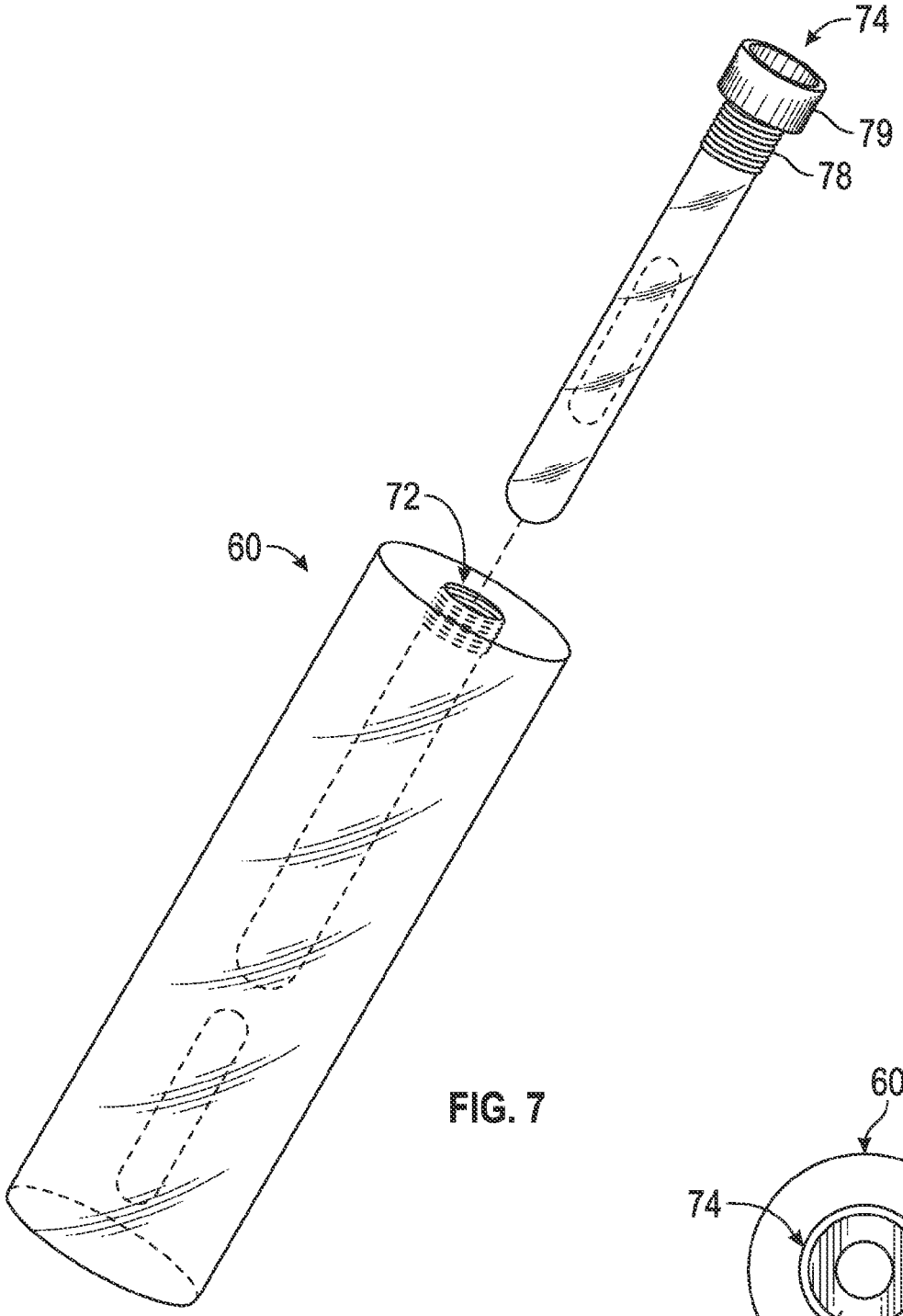
FIG. 7 is a perspective view of the embodiment of FIG. 6.
Figure 8:
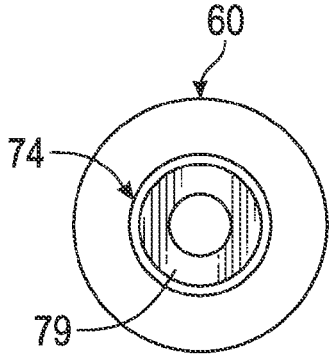
FIG. 8 is a top view of the embodiment of FIG. 6.

Referring now to FIGS. 6-8, according to one embodiment of the present invention, glow stick 60 comprises casing 62, made for example of plastic commodity resins such as PVC, PE, PS, Nylon, Rubber, Silicon, or Vinyl (but not limited thereto). Casing 62 comprises, chemo-luminescent reagent holding area 64, which comprises first solution 66, for example, phenyl oxalate and fluorescent die, and breakable ampoule 68 inside of it. Breakable ampoule 68 is filled with second solution 70, for example, a hydrogen peroxide solution, for chemiluminescence. When breakable ampoule 68 is broken through some type of manipulation, e.g., squeezing or bending casing 62, second solution 70 is released and mixes with first solution 66, reacting to produce chemiluminescence. Glow stick 60 also preferably comprises cavity 72 which can be, in one embodiment, cylindrical in shape. Cavity 72 can accommodate container 74 of a shape that fits in it for a substance such as, but not limited to, liquor, paint, candy, antibiotic ointment, hand sanitizer, intimate lubricant ("lube"), etc.

In a different embodiment container 74 can contain third solution 76, for example a solution comprising a phosphor, preferably of a different wavelength to create different fluorescent colors inside container 74, and breakable ampoule 77 comprising fourth solution 75, for example a hydrogen peroxide solution for chemiluminescence when ampoule 77 is broken and the solutions are mixed. In one embodiment, container 74 protrudes form the cavity 72, for example, for visual effects. Optionally, container 74 comprises means to attach to cavity 72. For example container 74 can comprise threated portion 78 that threads to cavity 72 to remain in place. Optionally, container 74 comprises one or more caps 79 or other means to make it openable/closable, and/or means to dispense its contents, for example, a squeeze dispenser for lotions, hand sanitizers, candy, etc.

Also disclosed are methods of distributing substances along with a glow stick. In one embodiment, a method comprises providing a glow stick with a cavity that can accommodate a container for the substance, placing the container for the substance in the cavity, and distributing the combined product.

In a different embodiment, the method comprises providing an ordinary glow stick, disposing a container of a substance on the glow stick, and distributing the combined product.

Also disclosed are methods of distributing substances in a container comprising an LED light comprising manufacturing a container with an LED light integrated or detachable, filling up the container with the substance or product, and distributing the resulting combined product.

Also disclosed is a method of promoting products and services comprising affixing advertisements to a glow stick combined with a container of an substance or a solution comprising a phosphor of a different wavelength than the glow stick to create different fluorescent colors around or inside a glow stick, or a container for an substance comprising and LED light, and distributing it.

INDUSTRIAL APPLICABILITY

The invention is further illustrated by the following non-limiting examples.

Example 1

A glow stick comprising a plastic casing was filled with phenyl oxalate and fluorescent die. A glass vial containing a hydrogen peroxide solution for a chemiluminescence reaction when broken was placed inside the plastic casing. The glow stick had a cylindrical cavity in its middle where a lube container was placed to be sold as a single unit for use at night clubs.

Example 2

A flexible hose-like container was filled with liquid candy, wrapped around a glow stick, and secured at the top and bottom of the glow stick with modified caps that could accommodate the ends of the flexible hose-like container. The combined product was marketed as a single unit for use during Halloween night.

Example 3

A container comprising six capped, openable, long test tube-like containers was disposed on a glow stick to form a glow stick carrier apparatus. The six containers were secured to the glow stick though modified glow stick caps that had snapping projections to hold each tube. The tubes could be detached individually. The tubes were labeled with promotion text and filled with liquor to be promoted. The apparatus was marketed as a single unit.

The preceding examples can be repeated with similar success by substituting the generically or specifically described reactants and/or operating conditions of this invention for those used in the preceding examples.

Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus comprising:

a tube holder comprising a plurality of projections extending radially therefrom;

a central portion of said tube holder adapted to receive a light source;

a plurality of carrier tubes removably positionable with respect to the light source when the light source is disposed in said central portion of said tube holder and said plurality of carrier tubes removably positionable with respect to said plurality of projections;

at least one cap, wherein at least one of said carrier tubes is openable and closable with said cap; and said projections holding said carrier tubes in a substantially parallel relationship with one another.

2. The apparatus of claim 1 wherein at least one said carrier tubes comprises a closed end.

3. The apparatus of claim 1 wherein at least one of said carrier tubes is transparent or translucent.

4. The apparatus of claim 1 wherein said tube holder holds said carrier tubes such that they encircle the light source.

5. The apparatus of claim 4 wherein said carrier tubes spin around the light source.

6. The apparatus of claim 1 wherein the light source comprises a chemiluminescent glow stick.

7. The apparatus of claim 1 wherein each of said carrier tubes comprises a cap.

8. The apparatus of claim 1 wherein said tube holder further comprises a lanyard for hanging said apparatus around a user's neck.

9. The apparatus of claim 1 further comprising an elastic band.

10. The apparatus of claim 1 wherein the light source comprises a light-emitting diode.

11. The apparatus of claim 1 wherein a tobacco product is disposed within at least one of said carrier tubes.

12. The apparatus of claim 1 wherein an alcoholic substance is disposed within at least one of said carrier tubes.

13. The apparatus of claim 1 wherein a food product is disposed within at least one of said carrier tubes.

14. The apparatus of claim 1 wherein a drug or pharmaceutical substance is disposed within at least one of said carrier tubes.

15. The apparatus of claim 1 wherein a flower is disposed within at least one of said carrier tubes.

16. The apparatus of claim 1 wherein money is disposed within at least one of said carrier tubes.

17. The apparatus of claim 1 wherein an electronic device is disposed within at least one of said carrier tubes.

18. The apparatus of claim 1 wherein a first-aid supply is disposed within at least one of said carrier tubes.

19. The apparatus of claim 1 wherein a survival supply is disposed within at least one of said carrier tubes.

20. The apparatus of claim 1 wherein an item of jewelry is disposed within at least one of said carrier tubes.

21. The apparatus of claim 1 wherein sanitizer is disposed within at least one of said carrier tubes.

22. The apparatus of claim 1 wherein a lubricant is disposed within at least one of said carrier tubes.

23. The apparatus of claim 1 wherein a solution for making bubbles is disposed within at least one of said carrier tubes.

24. The apparatus of claim 1 wherein said cap comprises a bubble blower.

25. An apparatus comprising:

a plurality of carrier tubes;

at least one cap, wherein at least one of said carrier tubes is openable and closable with said cap;

a tube holder;

a central portion of said tube holder adapted to receive a light source;

said tube holder further comprising a plurality of snapping projections extending radially therefrom, said snapping projections adapted to hold said carrier tubes such that said carrier tubes can be snapped on and off of said tube holder and such that said carrier tubes are removably positionable with respect to the light source when the light source is disposed in said central portion of said tube holder; and said snapping projections holding said carrier tubes in a substantially parallel relationship with one another.

26. The apparatus of claim 25 wherein at least one of said carrier tubes comprises a closed end.

27. The apparatus of claim 25 wherein at least one of said carrier tubes is transparent or translucent.

28. The apparatus of claim 25 wherein said tube holder holds said carrier tubes such that they encircle the light source.

29. The apparatus of claim 28 wherein said carrier tubes spin around the light source.

30. The apparatus of claim 25 wherein the light source comprises a chemiluminescent glow stick.

31. The apparatus of claim 25 wherein at least one of said carrier tubes comprises a cap.

32. The apparatus of claim 25 further comprising an elastic band.

33. The apparatus of claim 25 wherein the-light source comprises a light-emitting diode.

34. The apparatus of claim 25 wherein a tobacco product is disposed within at least one of said carrier tubes.

35. The apparatus of claim 25 wherein an alcoholic substance is disposed within at least one of said carrier tubes.

36. The apparatus of claim 25 wherein a food product is disposed within at least one of said carrier tubes.

37. The apparatus of claim 25 wherein a drug or pharmaceutical substance is disposed within at least one of said carrier tubes.

38. The apparatus of claim 25 wherein a flower is disposed within at least one of said carrier tubes.

39. The apparatus of claim 25 wherein money is disposed within at least one of said carrier tubes.

40. The apparatus of claim 25 wherein an electronic device is disposed within at least one of said carrier tubes.

41. The apparatus of claim 25 wherein a first-aid supply is disposed within at least one of said carrier tubes.

42. The apparatus of claim 25 wherein a survival supply is disposed within at least one of said carrier tubes.

43. The apparatus of claim 25 wherein an item of jewelry is disposed within at least one of said carrier tubes.

44. The apparatus of claim 25 wherein sanitizer is disposed within at least one of said carrier tubes.

45. The apparatus of claim 25 wherein a lubricant is disposed within at least one of said carrier tubes.

46. The apparatus of claim 25 wherein a solution for making bubbles is disposed within at least one of said carrier tubes.

47. The apparatus of claim 25 wherein said cap comprises a bubble blower.

* * * * *